US007568443B2

(12) United States Patent
Walker

(10) Patent No.: US 7,568,443 B2
(45) Date of Patent: Aug. 4, 2009

(54) BOAT RUDDER WITH INTEGRATED DYNAMIC TRIM FOILS

(76) Inventor: Jeff Walker, 2687 Elston St., Livermore, CA (US) 94550

( * ) Notice: Subject to any disclaimer, the term of this patent is extended or adjusted under 35 U.S.C. 154(b) by 21 days.

(21) Appl. No.: 11/595,488

(22) Filed: Nov. 9, 2006

(65) Prior Publication Data

US 2007/0125287 A1 Jun. 7, 2007

Related U.S. Application Data

(60) Provisional application No. 60/597,127, filed on Nov. 11, 2005.

(51) Int. Cl.

| | |
|---|---|
| ***B63H 25/06*** | (2006.01) |
| *B63B 1/00* | (2006.01) |
| *B63B 1/24* | (2006.01) |
| *B63B 1/26* | (2006.01) |
| *B63B 1/28* | (2006.01) |
| *B63B 1/22* | (2006.01) |

(52) U.S. Cl. ..... 114/162; 114/271; 114/274; 114/280; 114/281; 114/285

(58) Field of Classification Search ..... 114/162, 114/271, 274, 280, 281, 285
See application file for complete search history.

(56) References Cited

U.S. PATENT DOCUMENTS

| | | | | |
|---|---|---|---|---|
| 3,001,502 | A * | 9/1961 | Stoker | 114/167 |
| 3,120,829 | A * | 2/1964 | Chew et al. | 114/162 |
| 3,433,195 | A * | 3/1969 | Poole | 114/274 |
| 3,980,035 | A * | 9/1976 | Johansson | 440/66 |
| 5,041,040 | A * | 8/1991 | Jones et al. | 441/69 |
| 6,578,506 | B2 * | 6/2003 | Bieker | 114/39.24 |
| 6,863,013 | B2 * | 3/2005 | Noyes, Jr. | 114/285 |
| 7,063,031 | B2 * | 6/2006 | Earl et al. | 114/162 |

* cited by examiner

*Primary Examiner*—Lars A Olson
*Assistant Examiner*—Daniel V Venne
(74) *Attorney, Agent, or Firm*—Law Office of Alan W. Cannon

(57) ABSTRACT

A rudder and dynamic trim adjusting apparatus for a boat includes a rudder, a rudder shaft extending from the rudder and being rotatable about a longitudinal axis thereof to rotate the rudder, trim fins extending from the rudder, along at least one transverse axis transverse to the longitudinal axis, and a mechanism connected to the trim fins, and being operable, independently of rotation of the rudder shaft to rotate the trim fins about the at least one transverse axis. Methods of controlling an attitude of a boat hull are provided.

23 Claims, 11 Drawing Sheets

BOAT RUDDER WITH INTEGRATED DYNAMIC TRIM FOILS

CROSS-REFERENCE

This application claims the benefit of U.S. Provisional Application No. 60/597,127, filed Nov. 11, 2005, which application is incorporated herein by reference, and to which we claim priority under 35 U.S.C. Section 119(e).

FIELD OF THE INVENTION

The present invention relates to a rudder for a boat, more particularly a rudder providing dynamically adjustable stabilization.

BACKGROUND OF THE INVENTION

In most, if not all propeller-driven power boats, the driving of the boat by the propeller tends to raise the bow of the boat and draw the stern downwardly, wherein variations in degree of this phenomenon may occur with variations in the amount of power applied, or speed of the propeller, among other variables, such as size of the propeller blades, depth in the water of the propeller, etc. In extreme cases, such as racing hydroplanes, this phenomenon, if not controlled can cause disastrous results, as it is not uncommon to see one of these boats flip over, end-to-end, during racing speeds.

On the other hand, with the rising popularity of the sport known as wakeboarding, specialized wakeboarding boats have been developed to effect an even lower disposition of the stern of the boat to generate a larger wake for the wakeboarder to ride over. One approach has been to provide a boat with a fillable bladder or ballast tank in the stern portion of the boat. When water is added to this bladder or tank, the stern sits lower in the water and this causes a larger wake to be generated when pulling a wakeboarder then would be generated if the bladder or tank were empty of water. When it is desired to use the boat for purposes other than wakeboarding, e.g., water skiing, fishing or joy riding, the operator will typically pump the water out of the tank or bladder so that the stern can resume its naturally higher orientation in the water, thereby causing less drag, generating a smaller wake, and providing better fuel efficiency. This process is time-consuming, and can be particularly annoying when out in the water and waiting to empty the tank or bladder. Further, the engine of these boats is typically toward the stern of the boat to further enhance the wake formation, as the weight of the engine towards the back helps depress the stern. Therefore even after pumping all of the water out of the tank or bladder, the boat is still not necessarily as efficient in going through the water as it could be.

It would be desirable to provide a solution for addressing both types of these problems, i.e., not only being able to control the amount of raising in the bow of the boat to stabilize it, but also providing the ability to raise the stern, such as in the case of a wakeboarding boat for example. In the case of wakeboarding boats, it would be desirable to eliminate the need for the plumbing, pumps, ballast tanks/bladders while still providing the ability to produce a larger wake.

Most trim solutions that are currently provided for boats have only the ability to depress the stern lower than it would normally ride if no trim forces were applied. Thus, these solutions do not provide the ability to raise the stern higher than it would normal ride during propulsion if no trim forces were applied (neutral position), thereby also forcing the bow of the boat downward.

U.S. Pat. No. 3,120,829 to Chew discloses a boat rudder device with planning angle trim plates that are adjustable to effect the planning angle of the boat that the rudder is attached to. Chew's device is mounted to a keel and is therefore not easily adaptable to existing boats for modification thereof. All of the adjustment mechanisms for the device are exposed to the environment and thus susceptible to corrosion and failure, not only from corrosion, but also by being fouled by seaweed, brush, or other environmental nuisances. Further, by providing the trim adjusting mechanism to include the drum 45 engaging the steering post 15, this device experiences an undesirable effect when the boat is being turned via the steering post and rudder. That is, turning of the steering post to move the rudder and turn the boat also causes an adjustment of the trim foils by virtue of the change in tension on the cables wrapped around the drum 45, as the drum also rotates with the rotation of the steering post 15. Still further, the trim plates 20,21 of Chew's device are not dynamically balanced. That is, when the leading edges of the trim plates are adjusted downwardly, the force of the water over the leading edges of the trim plates will make it difficult to return the trim plates to neutral (horizontal) because the trim plates are pivoted at the extreme rear ends thereof. Similarly, when the leading edges of the trim plates are adjusted upwardly, the force of the water under the leading edges of the trim plates will make it difficult to return the trim plates to neutral (horizontal) because the trim plates are pivoted at the extreme rear ends thereof.

Accordingly, there is a continuing need for devices to control the height/position of the stern of the boat in the water, including not only the ability to depress the stern from a neutral position, but also the ability to raise the stern above its neutral position. There is a need for better solutions for increasing the wake making ability of a boat for use in wakeboarding sports. There is a need for better control of the relative heights of the stern and bow, which is independent of the steering of the boat (rudder control). There is further a need for providing controls of such a device so that they are less exposed to the environment and therefore less susceptible to fouling and/or corrosion. Still further, it would be desirable to provide controls that are dynamically balanced, such that adjusting the controls from a neutral position to a position to raise or lower the stern requires substantially no more or less force than required for returning the controls from that position back to the neutral position.

SUMMARY OF THE INVENTION

A rudder and dynamic trim adjusting apparatus for a boat is provided that includes: a rudder; a rudder shaft having a longitudinal axis, the rudder shaft extending from the rudder and being rotatable about the longitudinal axis to rotate the rudder; trim fins extending from the rudder, along at least one transverse axis transverse to the longitudinal axis; and a mechanism connected to the trim fins, wherein the mechanism is operable independently of the rotation of the rudder shaft to rotate the trim fins about the at least one transverse axis.

In at least one embodiment, the transverse axis along which the trim fins extend is substantially perpendicular to the longitudinal axis of the rudder shaft.

In at least one embodiment, the mechanism includes a pair of transverse shafts, each transverse shaft having a flat to prevent rotation of the trim fin received thereover, with respect to the transverse shaft, respectively.

In at least one embodiment, the trim fins are dynamically balanced in rotation about the transverse shafts.

In at least one embodiment, the flats are angularly offset to compensate for hull torque.

In at least one embodiment, a driver is operatively connected to the mechanism to drive the mechanism to rotate the fins.

In at least one embodiment, the driver comprises a motor geared to the mechanism, the motor being operable to drive the mechanism to rotate the fins.

In at least one embodiment, the driver comprises a hydraulic drive operably connected to the mechanism to drive the mechanism to rotate the fins.

The driver is bi-directionally operable, and the fins are rotatable to exert an upward force on a stern of a boat that the apparatus is connected to or a downward force on the stern.

In at least one embodiment, the driver is dynamically adjustable to dynamically adjust a height of the stern in the water during operation of the boat.

In at least one embodiment, an actuator is provided that is actuatable to operate the driver.

In at least one embodiment, the actuator is manually operable by an operator.

In at least one embodiment, the actuator is automatically operable to dynamically adjust the trim fins to maintain a predetermined height of the stern of the boat relative to a bow of the boat.

In at least one embodiment, the actuator is located in a tow rope handle of a tow rope configured to be attached to a boat.

In at least one embodiment, a bow sensor is provided that communicates with the actuator, wherein the actuator is automatically operable in response to signals received from the bow sensor.

A method of dynamically controlling an attitude of a boat hull is provided, including the steps of: providing an apparatus attached to the boat hull, the apparatus having trim fins that are rotatable to provide an upward or downward force on a portion of the boat hull; providing at least one sensor on the boat hull capable of indicating relative motion of at least a portion of the boat hull; setting a desired attitude of the boat hull on a control actuator configured to dynamically adjust the trim fins; and automatically and dynamically adjusting the trim fins, in response to a signal received from the at least one sensor, to change attitude of the boat hull toward the desired attitude having been set.

In at least one embodiment, the signals provided by the at least one sensor and signals controlling rotation of the trim fins are provided in a negative feedback loop, so that continuous dynamic adjustment of the attitude of the boat hull is performed.

In at least one embodiment, a trim fins position sensor is provided, wherein the actuator receives a signal from the trim fins position sensor to indicate attitude of the trim fins.

A method of controlling an attitude of a boat hull is provided, including the steps of: providing an apparatus attached to the boat hull, the apparatus having trim fins that are rotatable to provide an upward or downward force on a portion of the boat hull, wherein the trim fins are mechanically controlled by a mechanism that is independent of steering the boat hull by controlling movements of a rudder; providing a control actuator configured to control rotations of the trim fins; setting a desired attitude of the boat hull on the control actuator; and automatically adjusting the trim fins to provide an upward or downward force on the stern of the boat hull to achieve the desired attitude having been set.

In at least one embodiment, the trim fins are rotatable in first and second opposite directions, and wherein the trim fins are positionable at trim fin attitudes to vary levels of down force on the stern, as well as vary levels of up force on the stern.

In at least one embodiment, the desired attitude is a setting to lower the stern of the boat to create an increased wake size for use in wakeboarding sports.

In at least one embodiment, the desired attitude is a setting to raise the stern of the boat relative to a neutral hull attitude that the hull sits at when not moving, to create a reduced wake size for use in waterskiing sports.

These and other features of the invention will become apparent to those persons skilled in the art upon reading the details of the apparatus and methods as more fully described below.

BRIEF DESCRIPTION OF THE DRAWINGS

FIG. 5 is a schematic representation of the apparatus of FIG. 1 installed on a boat and showing electronic control components that may be provided to control actuation thereof.

DETAILED DESCRIPTION OF THE INVENTION

Before the present apparatus and methods are described, it is to be understood that this invention is not limited to particular embodiments or components described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a set screw" includes a plurality of such set screws and reference to "the wire" includes reference to one or more wires and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Figure 1:
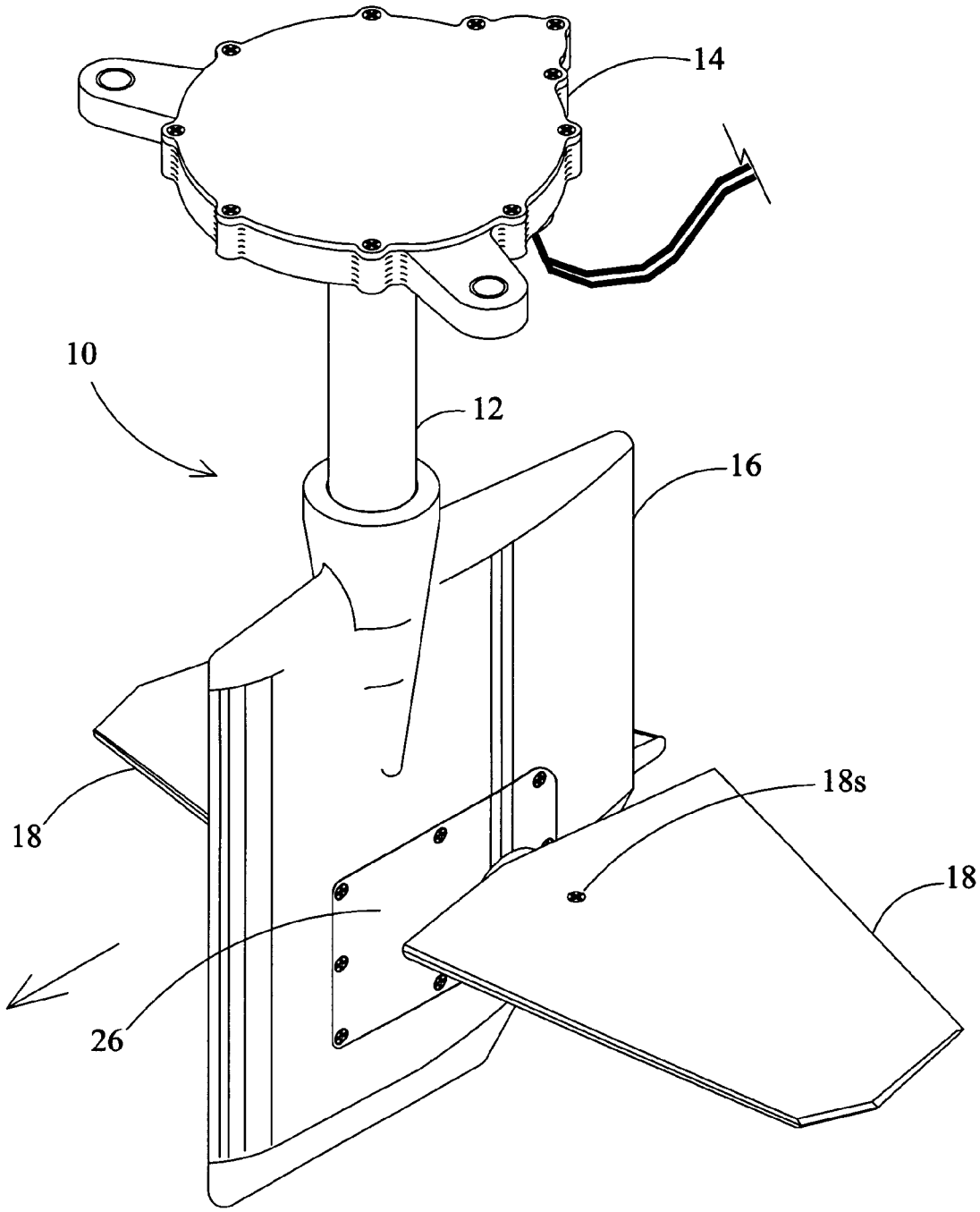
FIG. 1 is a perspective view of an embodiment of a rudder and dynamic trim adjusting apparatus according to the present invention.
Figure 2:
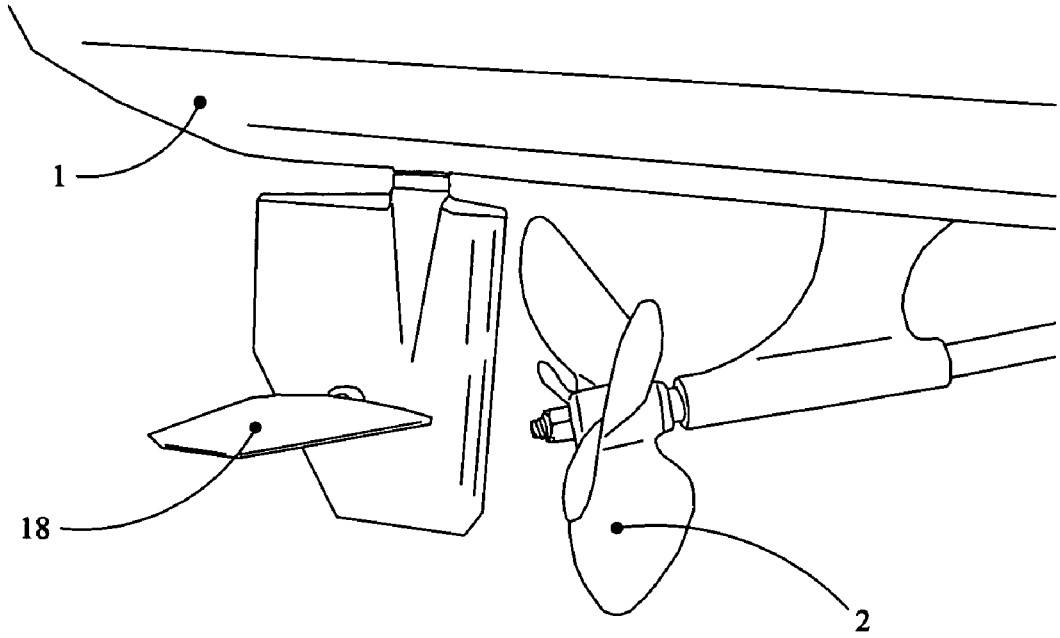
FIG. 2 shows n embodiment of a rudder and dynamic trim adjusting apparatus installed on a boat according to the present invention.

FIG. 1 is a perspective view of an embodiment of a rudder and dynamic trim adjusting apparatus 10 according to the present invention. Apparatus 10 includes a rudder shaft 12 extending between and interconnecting gear housing 14 and the rudder 16 and fins 18 assembly. Rudder shaft 12 is hollow and is cast into rudder 16, which may be made of brass, copper, or aluminum, for example. Apparatus 10 is configured to be mounted through the bottom of the hull of a boat 1 as shown in FIG. 2. Apparatus 10 is typically mounted so that the plane of the fins 18 in the neutral position (shown in FIG. 2) is aligned or near the axis of the shaft of propeller 2. Rudder shaft 12 is inserted through an opening in the bottom of the hull and gear housing 14 is then clamped at the top end of shaft 12 in the configuration shown in FIG. 1. Shaft 12 is fixed to the hull using a snap ring and tiller arm arrangement that has a set screw. The snap ring and tiller arm arrangement encircles shaft 12. A bearing (e.g., polytetrafluoroethylene bearing) is positioned on the shaft between the rudder and through hole in the hull, and a thrust needle bearing is positioned on the top side of the opening in the hull, against which the snap ring and tiller arm are mounted, and secured against shaft 12 by torquing the set screw thereagainst.

Rudder shaft 12 is connected to the steering controls of the boat 1 in conventional manner, e.g., so that turning the steering wheel (not shown) of the boat left or right causes the shaft 12 to rotate right or left (counter clockwise or clockwise) to turn the boat left or right, respectively. Control rod 20 is provided as a threaded shaft and is inserted through rudder shaft 12, rudder shaft 12 being hollow (tubular), as shown in the exploded view of FIG. 3. Control rod 20 is freely rotatable with respect to rudder shaft, i.e., is not mechanically linked to rudder shaft, such that rotation of rudder shaft 12 and rotation of control rod 20 are completely independent of one another.

The lower end of control rod is threaded through control nut 22 through opening 22*t* (FIG. 4) that has threads that mate with the threads on control rod 20. Control nut 22 has a clevis 22*c* formed in one end thereof, into which elevator yoke 24 is inserted and pinned via pin 23. Elevator yoke 24 includes a slot 24*s* that allow some translational movement of elevator yoke 24 with respect to clevis 22*c* as elevator yoke 24 rotates up or down with respect to clevis 22*c* in the directions of the arrows shown. A transverse shaft 24*t* extends from each side of the elevator yoke and includes flats 24*t* on each side. Elevator fins 18 are provided with mating cylindrical openings therein, so that elevator fins 18 can be assembled over transverse shafts 24*t* into the assembled configuration shown in FIG. 1. In the assembled configuration, set screws 18*s* are threaded into threaded openings in the elevator fins 18 and tightened against flats 24*f*, thereby securing fins 18 from sliding off transverse shafts 24*t* and also preventing fins 18 from rotating axially about shafts 24*t*. The mating openings in fins 18 that are configured to receive shafts 24*t* may also have a flatted portion of the circumference thereof, so that these openings are keyed to the flatted shafts, as further prevention of axial rotation of the fins 18 about shafts 24*t*.

Figure 6A:
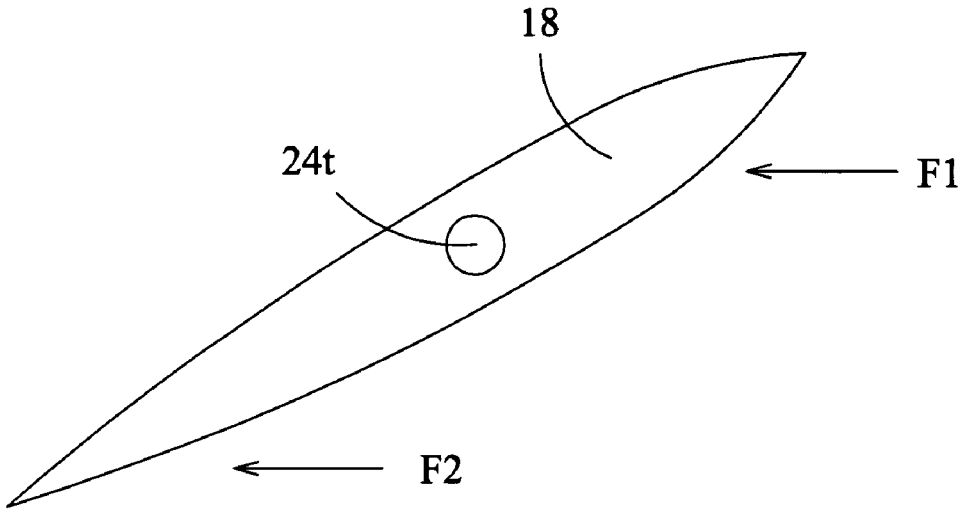
FIGS. 6A and 6B illustrate a fin in an elevated angle of attack and a depressed angle of attack, respectively.
Figure 6B:
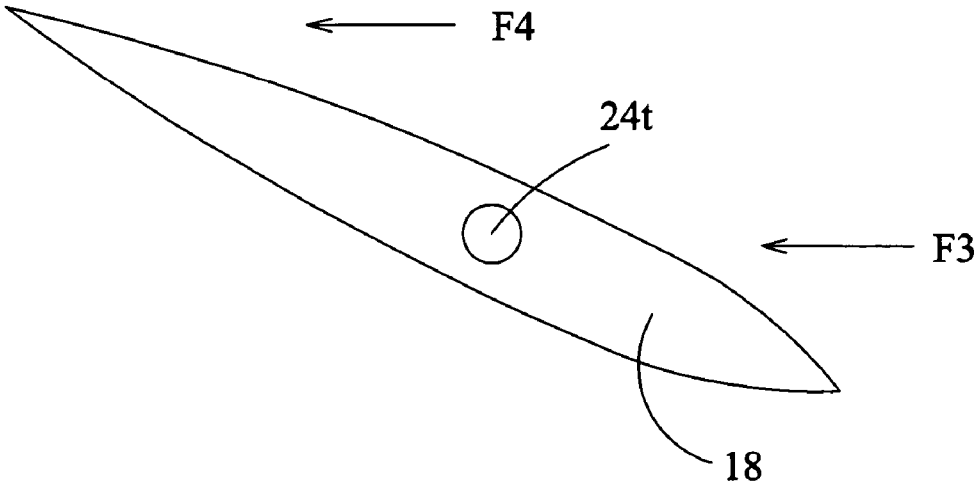

Fins 18 rotate with shafts 24*t* about the longitudinal axes of shafts 24*t* to change the angle of attack thereof to varying degrees (depending on the angle of attack, which is a function of the degree of rotation, and the speed of the boat) of upward or downward force on the stern of the boat 1. The openings in fins 18 that receive shafts 24*t* are provided to dynamically balance the fins as they are being rotated in the water about shafts 24*t*. For example, if the fins 18/boat are traveling to the right in the illustrations of FIGS. 6A and 6B, then when fins 18 are positioned at an angle of attack to cause upward force on the stern, such as illustrated in FIG. 6A, the fin 18 is designed and mounted such that the forces F, on the portion of the fin above shaft 24*t*/rotation point and thus resulting in a counterclockwise moment arm are substantially equal and opposite to the clockwise moment arm caused by the forces $F_2$ applied against the portion of the fin 18 below the shaft 24*t*/rotation point. Accordingly, rotation of the fin away from neutral does not require substantially more or less force than rotation from an elevated angle of attack back to neutral, resulting in much more stable control characteristics than known heretofore. Likewise, when fin 18 is in a downward or depressed angle of attack as illustrated in FIG. 6B, the moment arm caused by forces $F_3$ on the portion of the fin below shaft 24*t* is equal and opposite to the moment arm caused by forces $F_4$ on the portion of the fin above shaft 24*t*. Note that the pivot/rotation point where shaft 24*t* is inserted into fin 18 is not necessarily the midpoint along the length of the fin, but will vary depending upon the surface curvature of the fin on both top and bottom surfaces. The fins 18 shown in FIG. 1 employ NACA airfoil design 0008 (an airfoil shape developed by the National Advisory Committee for Aeronautics (NACA), although fins 18 are not to be limited to this design, as various other surface curvatures may be substituted, including, but not limited to other NACA airfoil designs.

Figure 4:
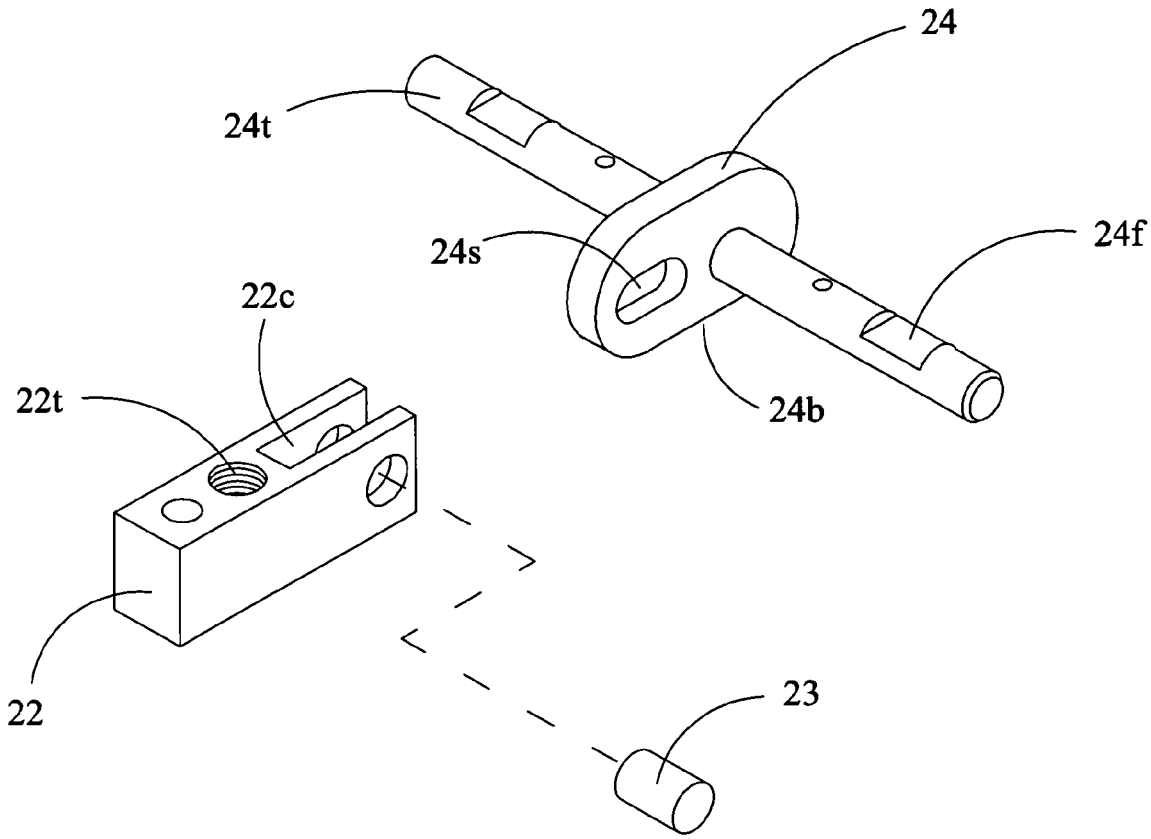
FIG. 4 is an enlarged view of a control nut and an elevator yoke.

Elevator yoke 24 includes a bearing surface 24*b* that is substantially circular in the view shown in FIG. 4, this portion of the elevator yoke 24 beings substantially cylindrical. Rudder 16 has a raced formed therein about which bearing surface 24*b* rotates against during operation of the controls to rotate the elevator yoke 24, with some tolerance for the yoke to travel up or down during rotation. Bearing surface 24*b* rides securely within the race formed in the rudder 16, and side plates 26 are securely mounted to the rudder 16, such as by screws, or the like, to prevent side movements of the elevator yoke 24 during operation. For example, tolerances between the sides of the yoke and the side plates 26 may be quite tight, on the order of about 0.003" to about 0.005".

Seals 26*s*, such as o-rings, for example, may be provided between shafts 24*t* and the openings in side plates 26 though which shafts 24*t* pass, to prevent water from entering into the enclosure in the rudder 16 that houses the components described above. This enclosure may further be filled with grease to prevent corrosion and reduce friction between the moving parts.

Optionally, fin yokes 18*y* may be screwed to the inside ends of fins 18 and provided with set screws 18*sy* for further securement of the fins 18 to shafts 24*t*, although these are not required, as noted.

When fins 18 are adjusted to apply downward force to the stern of the boat, a downward force is translated through control nut 22. Accordingly, to prevent translation of control nut 22 and the control mechanism downward, the bottom end of control rod 20 functions as a bearing surface, against a mating bearing surface formed in rudder 16, against which the mating surface at the end of control rod 20 abuts. Thus although control rod 20 is rotatable with respect to the mating surface of rudder 16, it does not translate with respect thereto, but stays pressed against this mating surface. On the other hand, when fins 18 are adjusted to apply upward force to the stern of the boat, an upward force is translated through control nut 22. Accordingly, to prevent translation of control nut 22 and the control rod 20 up and out of the rudder shaft 12, a bearing surface, bearing and snap ring are provided at the top of the rudder shaft 12 to generate a counterforce against the force of the control rod 20 as it tries to push upwardly. The fins 18, at maximum adjustment, either upwardly or downwardly have been tested to provide upwards of 3,000 pounds of vertical force (at a boat speed of about 35 miles per hour) on the stern of the boat, either upwardly or downwardly.

Gear housing 14 is assembled over the top end of control rod 20 and clamped in place at the top of rudder shaft 12. Drive gear 28 is mechanically engaged with the end of control rod 20 (such as by a flat and set screw arrangement, or interengaging gears or splines, for example), and is contained within gear housing 14. Motor 30 is mounted to gear housing 14 such that drive shaft 32 extends through opening 14*m*. Motor gear 34 which has teeth matched to the teeth of drive gear 28 for interengaging therewith is mounted on drive shaft 32 (such as by splines or other mechanical connection) such that the teeth of gears 34 and 28 mesh and gears 34 and 28 are contained within gear housing 14. Gear housing cover 14*c* is then secured to housing 14 (such as by screws or other mechanical connectors) thereby enclosing the gear housing 14.

Figure 3:
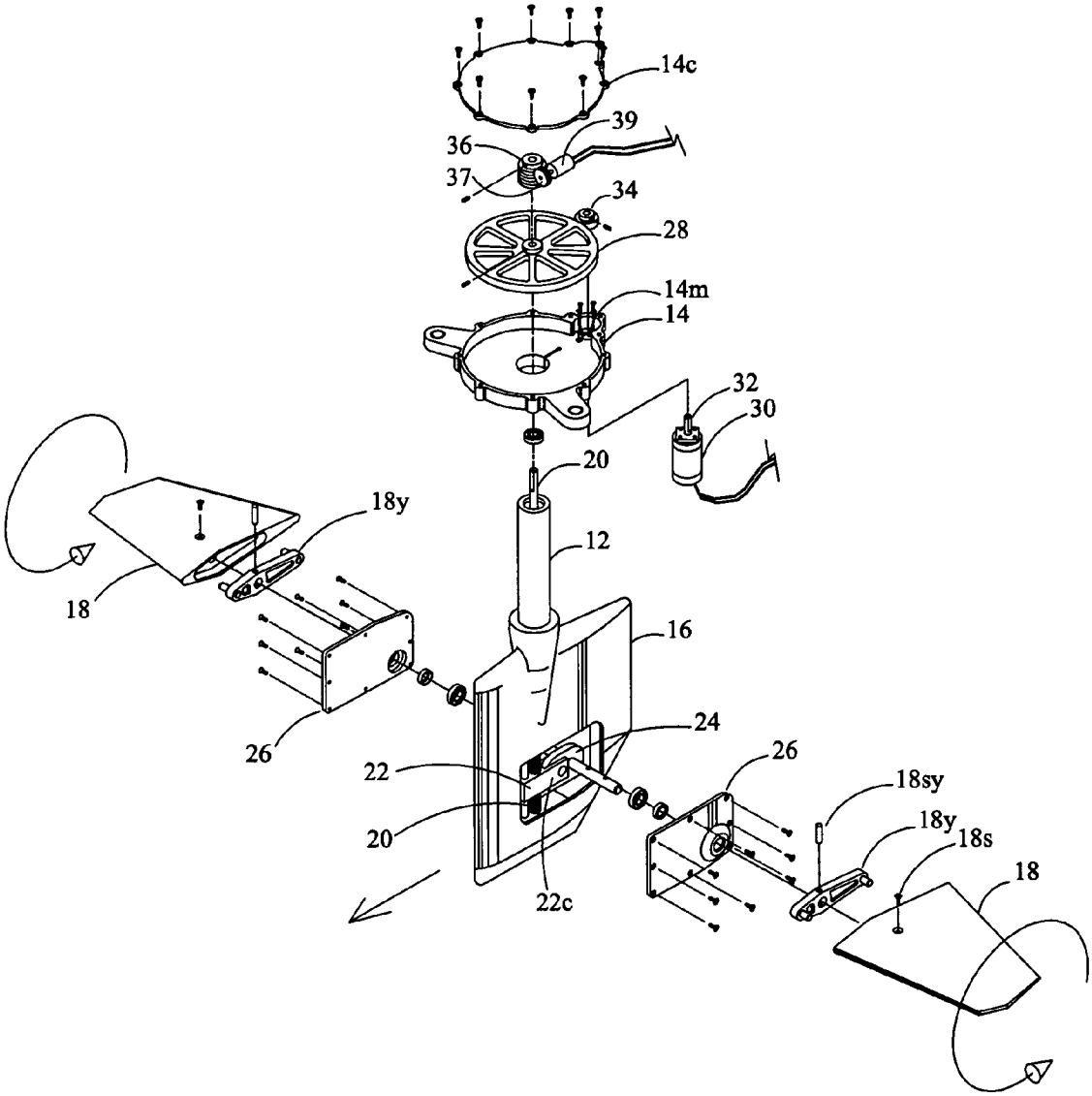
FIG. 3 is an exploded view of the apparatus shown in FIG. 1.

A worm 36 and worm gear 37 are provided and connected to a potentiometer 39 that provides an electronic signal that indicates the position of fins 18 relative to their neutral (i.e., horizontal, not driving upwardly or downwardly), to prevent over adjustment of the fins 18 in either direction, see FIG. 3. This prevents the motor from driving past the up or down limits of the fins 18, which could bind the gear assembly 34,28 and or other components of the control mechanism (20,22,24).

Figure 5:
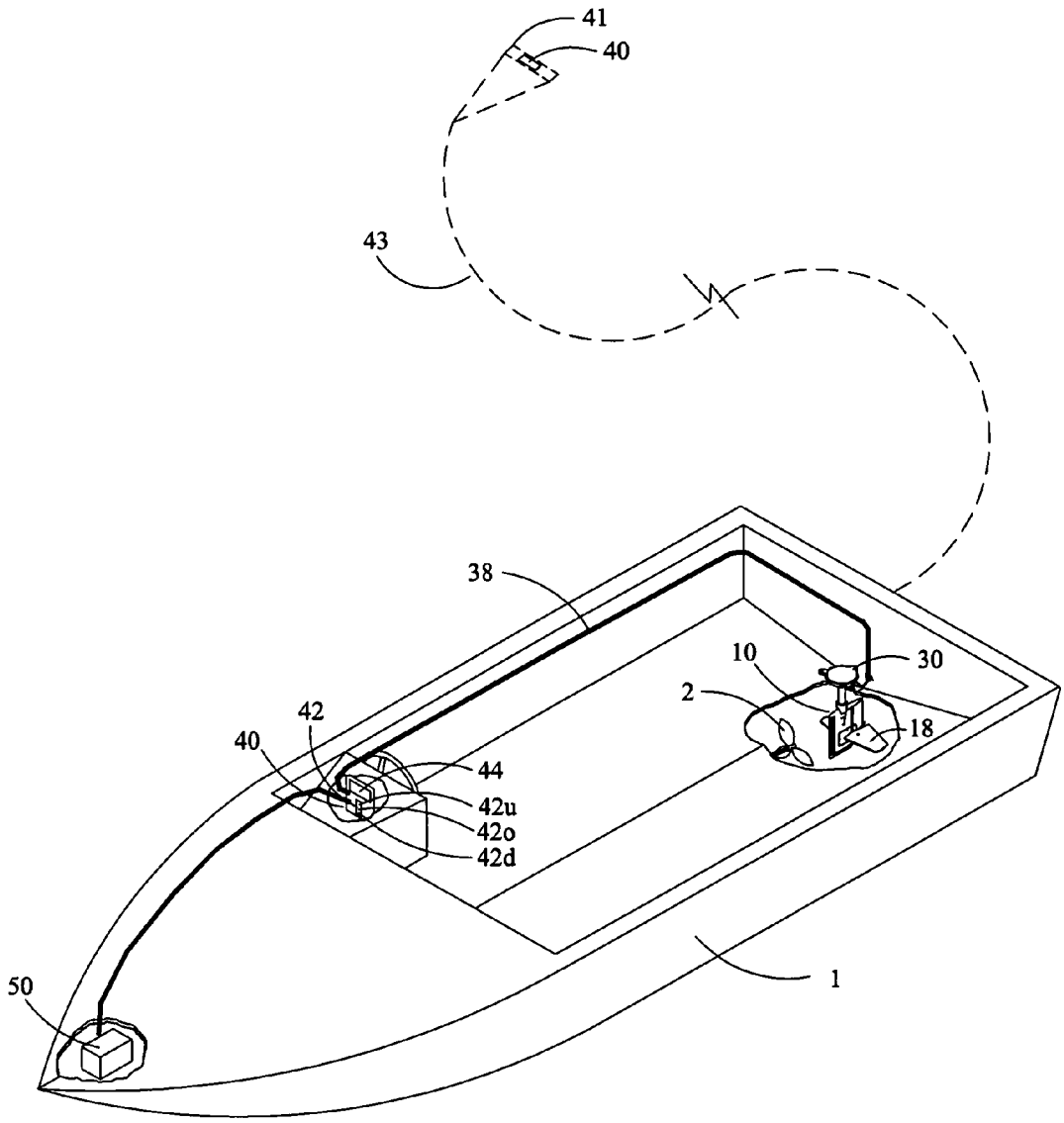
FIG. 5 illustrates a sensing mechanism for tracking the attitude of the fins.

FIG. 5 is a schematic representation of apparatus 10 installed on a boat 1 and showing electronic control components that may be provided to control actuation of motor 30. In one embodiment, motor 30 may be provided with an actuator right at the location of the motor 30 for manual operation to actuate rotation of motor in one of two opposite rotation directions, for changing the positions of fins 18 to provide more or less upward or downward force. Additionally, an "off" setting is provided to turn the motor off, i.e. stop rotation. In other embodiments, however, such as the embodiment shown in FIG. 5, for example, a remotely located actuator 40 is provided. Actuator 40 may be provided on the driver's console of the boat 1, for example, and may be hard wired to the motor 30 and potentiometer via wires 38. Alternatively, actuator 40 may be a handheld unit, that may be either hard wired or wireless. Additionally, such handheld unit 40 may be configured to be temporarily installed at the driver's console, and removable by the operator, at will. In another embodiment, the wireless remotely located actuator is located in or attached to the handle 41 of a tow rope 43 as illustrated in broken lines in FIG. 5.

Actuator 40 may include a manually operable control 42 that is manually adjustable between up 42*u*, off 42*o* and down 42*d* operating positions. Thus, moving control 42 to the 42*u* position causes rotation of the motor in a direction that repositions fins 18 toward providing more upward force (or less downward force). Conversely, moving control 42 to the 42*d* position causes rotation of the motor 30 in the opposite direction that repositions fins 18 toward providing more downward force (or less upward force). Positioning of control 42 in the 42*o* position stops rotation of the motor, whereby fins 18 are maintained in their current orientation.

Operation of motor 30 in one rotational direction drives control rod 20 in a first rotational direction (e.g., clockwise, although this could be counterclockwise by changing the threads on control rod 20 and control nut 22 to the opposite hand, for example). This rotation, via the meshing threads on control rod 20 and control nut 22 causes control nut to ride up control rod, thereby rotating elevator yoke for upward control (upward force on stern), rotating fins 18 in the rotational direction opposite the direction of the rotational arrows in FIG. 3, this increases the upward force (which includes lessening a downward force, depending upon the current positioning of the fins 18 when this rotational operation is begun, and wherein the direction of motion of the boat is in a forward direction, as indicated by the straight arrow in FIGS. 1 and 3) on the stern of the boat. Operation of motor 30 in the opposite rotational direction drives control rod 22 in a second rotational direction that is opposite to the above-mentioned first rotational direction. This rotation, via the meshing threads on control rod 20 and control nut 22 causes control nut to ride down control rod, thereby rotating elevator yoke for downward control, thereby rotating fins 18 in the direction shown by the rotational arrows in FIG. 3. This increases the downward force (which includes lessening an upward force, depending upon the current positioning of the fins 18 when this rotational operation is begun) on the stern of the boat. It is noted that once maximum rotation of fins 18 in either direction has been reached (or when the maximum limit is approached, within a predetermined distance therefrom, which may be settable in the control circuitry of the actuator 40) then in those embodiments that include rotation limiter (e.g., potentiometer 39), rotation of the motor in that direction is stopped/prevented from further rotation in that direction (although rotation in the opposite direction is still permitted) when actuator 40 receives a signal from rotation limiter 39 that one of these limits has been reached. Actuator 40 may further optionally be provided with an alarm (audio, visual or both) that is set off when one of these limits has been reached, just to alert the user of the same, although the killing of the motor rotation is automatic. Further optionally, the remotely located actuator 40 may include a display 44 that either graphically depicts or numerically displays (or both) the position of the fins 18 relative to neutral (horizontal). The relative heights or angle from bow to stern (or vice versa) may also be displayed (graphically and/or numerically).

Further optionally, a bow sensor 50 (such as an accelerometer, for example) may be placed in the bow of the boat 1 and electrically connected to actuator control unit 40, for use in automatic dynamic adjustment of trim. For example, as the bow of the boat begins running over a wave, this causes the bow to pitch upwardly. Bow sensor 50 will sense this acceleration in the upward direction. Output from bow sensor that indicates this change in attitude of the bow is received by actuator controller 40 which is programmable to maintain the bow at a predetermined pitch) or angle, i.e., height, relative to the stern of the boat. This predetermined pitch can be user settable, and therefore adjustable, for automatic, dynamic maintenance of the stern and bow heights for the current particular use desired by the user. Upon receiving a signal that the bow height is changing, actuator controller 40 actuates motor 30 to change the position of fins 18 to counter this motion and drive the bow in the opposite direction, toward the predetermined height/attitude. Using a negative feedback loop to the bow sensor 50, controller 40 can actively and dynamically make adjustments to fins 18 to maintain the boat bow and stern at the desired heights (which may be referred to as automatic, dynamic ride control), thus compensating at least partially for pitches resulting from hitting waves, etc., so that the relative heights of the stern and bow remain more nearly constant and at the desired relative height and/or angular settings. This ride control feature is also responsive to people moving around in the boat, for example. That is, if a passenger moves from a seat in the bow section of the boat back to a seat in the rear of the boat, then the bow tends to move upwardly. Bow sensor 50 would sense this and automatic dynamic control, as described above, would dynamically adjust the trim to maintain the desired relative positions of the bow and stern.

Figure 7:
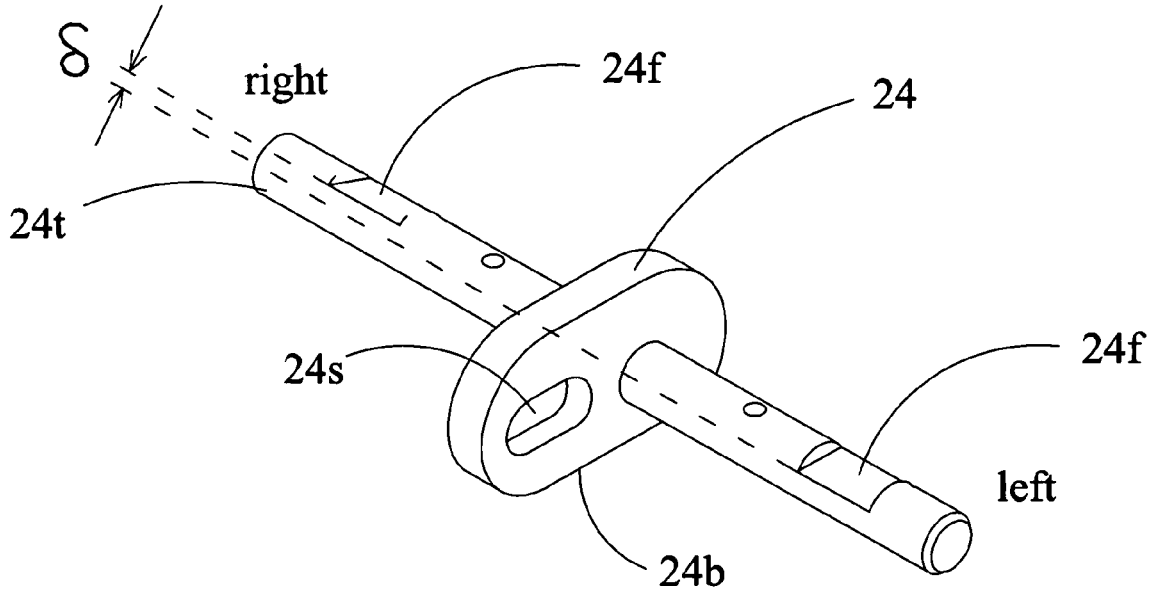
FIG. 7 schematically illustrates angular offsetting of flats to compensate for torque on a boat hull.
Figure 8A:
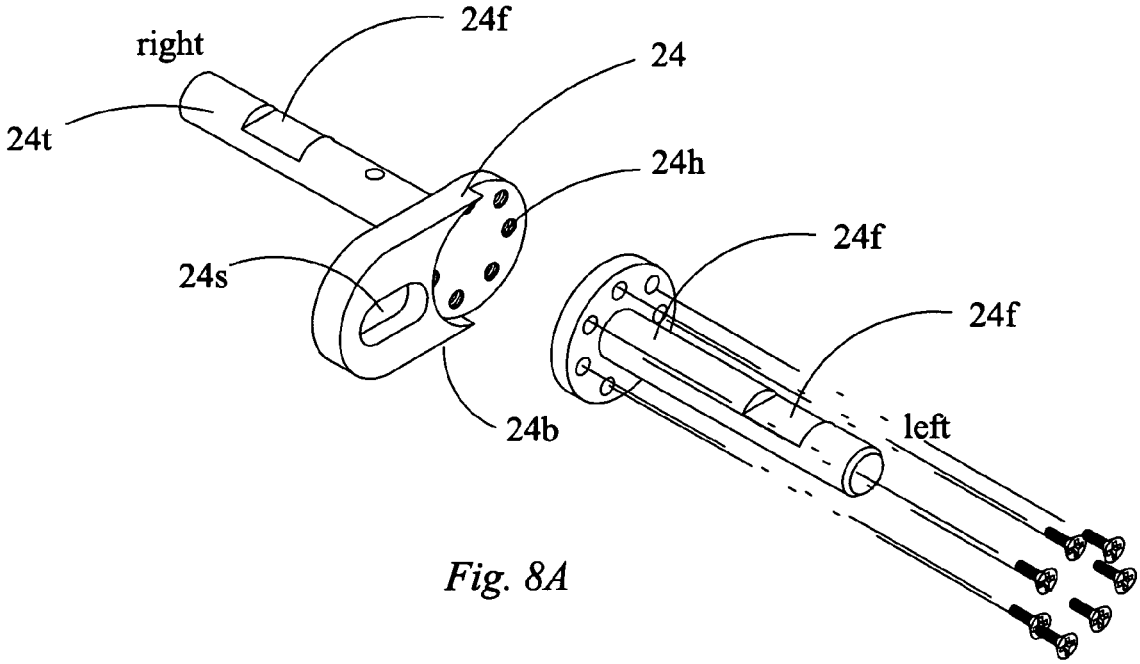
FIGS. 8A-8B schematically illustrate an elevator yoke with adjustable flat angle offset capability.
Figure 8B:
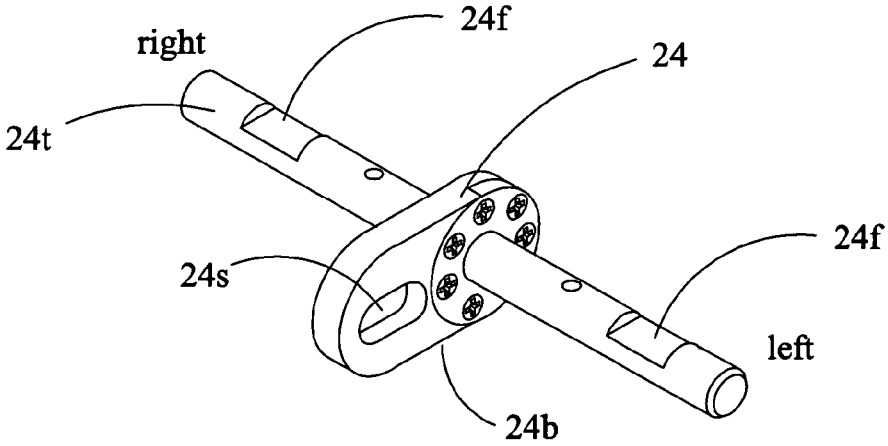

Another optional feature of apparatus 10 provides compensation for torque on the hull of the boat 1 that is caused by rotation of the propeller 2 during driving of the boat 1. For example, it is known that the torque of the propeller 2 exerted during driving the boat causes the hull to counter-rotate somewhat in response thereto. Thus, for example, if the propeller rotates counter-clockwise, this will cause a slight clockwise rotation of the hull in the water. In order to compensate/correct for this phenomenon, the flats on transverse shafts 24*t* may be rotationally offset with respect to one another by a small offset angle δ, as illustrated in FIG. 7, for example. This angle may be from about one to five degrees, e.g., about 2.5 degrees, although this angle may vary even beyond the one to five degree range depending upon the particular boat, motor and propeller arrangement, as the amount of torquing observed in the hull will be dependent upon horsepower/torque specifications of the boats motor, size and weight of the hull, and size of the propeller. In the example shown in FIG. 7, the flat 24*f* on the left transverse shaft 24*t* is offset from the flat 24*f* on the right transverse shaft 24*t* by an angle of about 2.5 degrees, so that the right fin 18 will have an angle of attack elevated by about 2.5 degrees with respect to the angle of attack of the left fin 18. This arrangement would cause slightly more lift on the right side of the boat to counter for a hull experiencing a clockwise torquing effect. Elevator yoke 24 may be designed as a two piece unit that splits in the center portion thereof along a plane perpendicular to the longitudinal axes of the transverse shafts, see FIG. 8A and the right end view of left half piece shown in FIG. 8B. The halves of the center portion are provided with mating adjustment holes 24*h*, with the holes in at least one half being threaded. Adjustment of the angle δ can then be accomplished by rotating one half with respect to the other until the mating holes 24*h* align in a pattern that achieves the desired angular difference between the left and right flats 24*f*. The halves can then be joined to integrate the elevator yoke, using screws or studs, for example.

Figure 9:
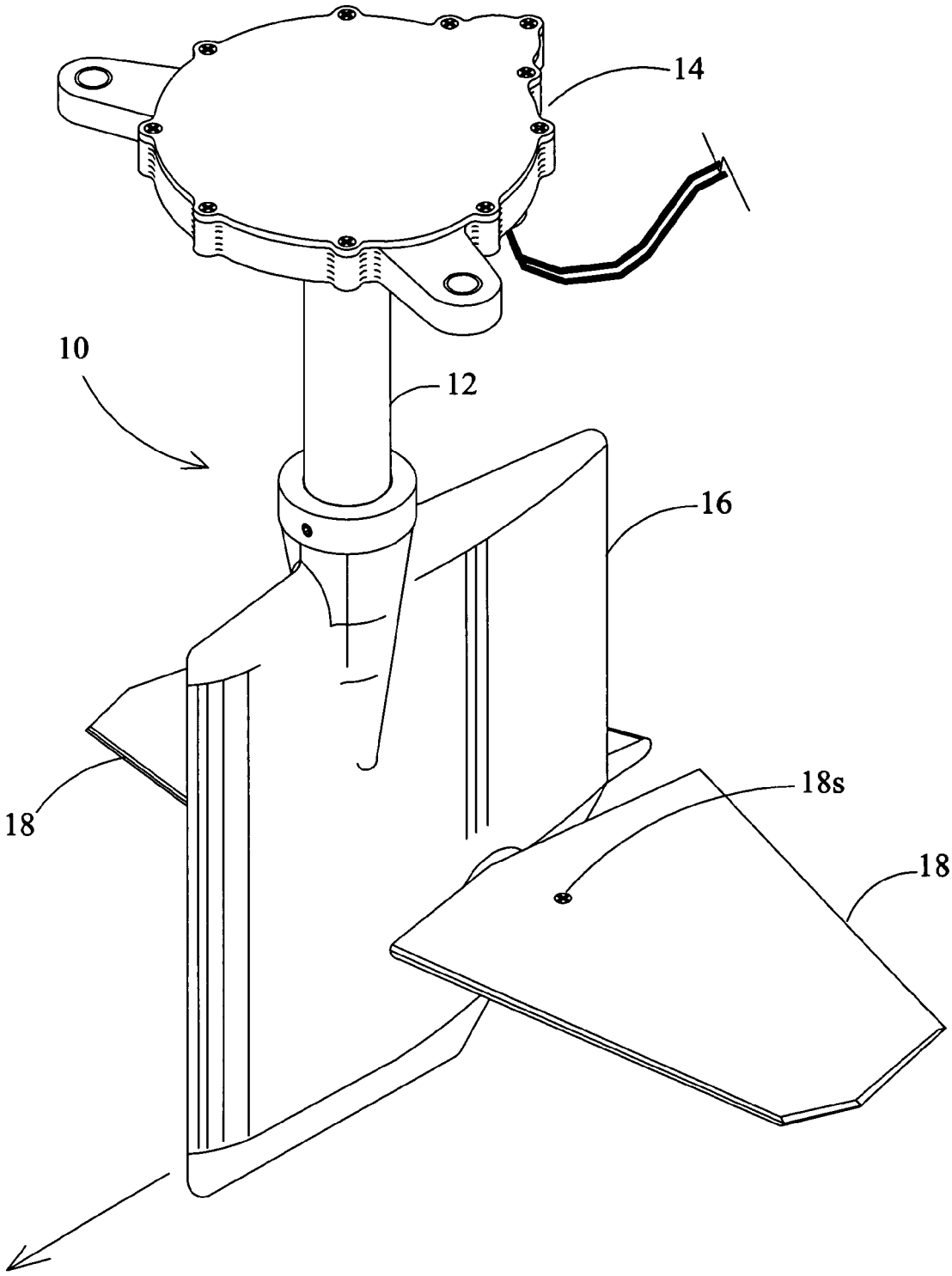
FIG. 9 is a perspective view of another embodiment of a rudder and dynamic trim adjusting apparatus according to the present invention.
Figure 10:
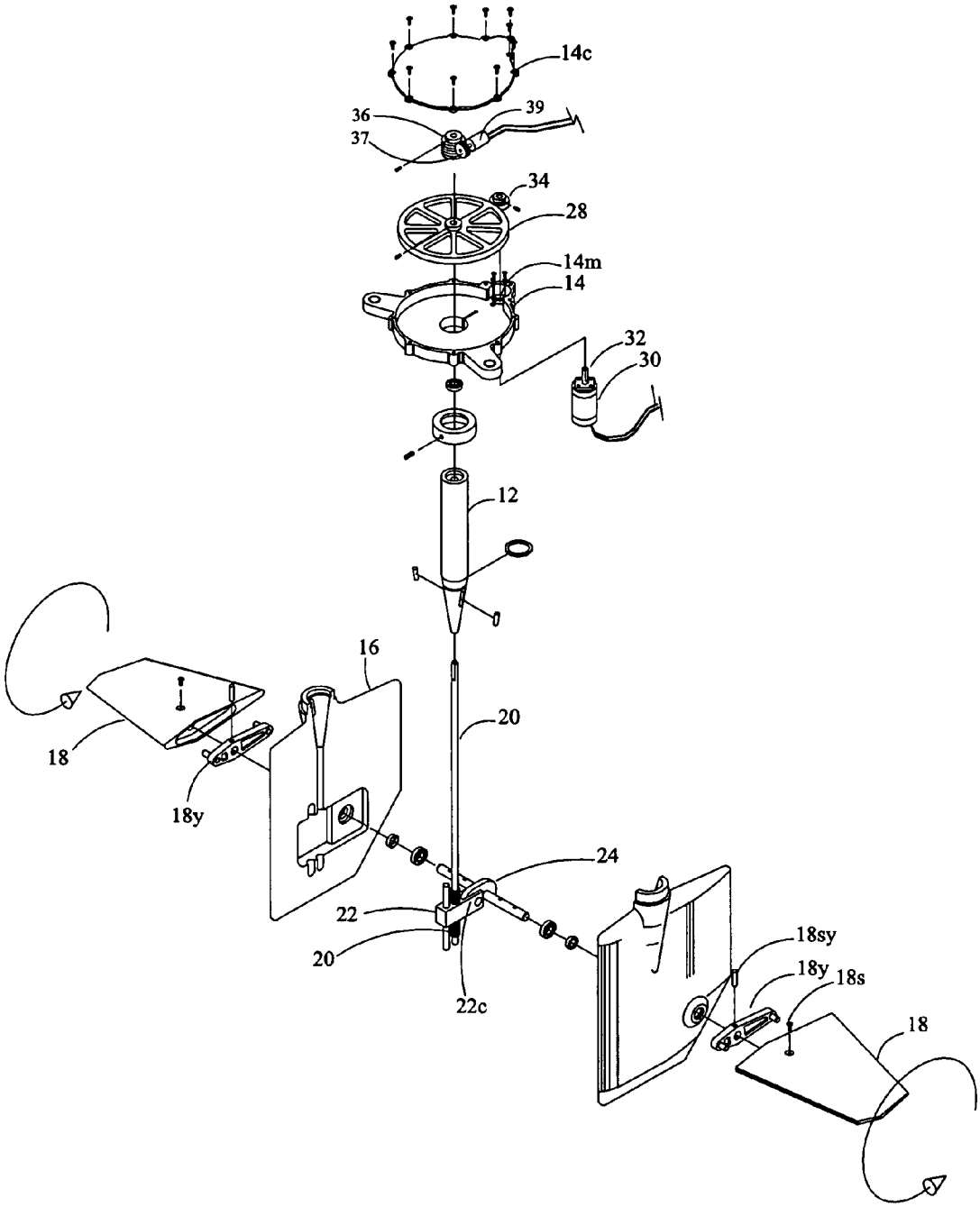
FIG. 10 is an exploded view of the apparatus shown in FIG. 9.

FIG. 9 shows another embodiment of apparatus 10 similar to that shown in FIG. 1, but where side plates 26 are not employed. Instead, in this embodiment, rudder 16 is splittable into halves, as shown in FIG. 10, to allow assembly the controlling mechanism for the fins 18. Seals 26, such as o-rings are provided at the openings in rudder 16 through which transverse shafts 24*t* protrude.

Figure 11:
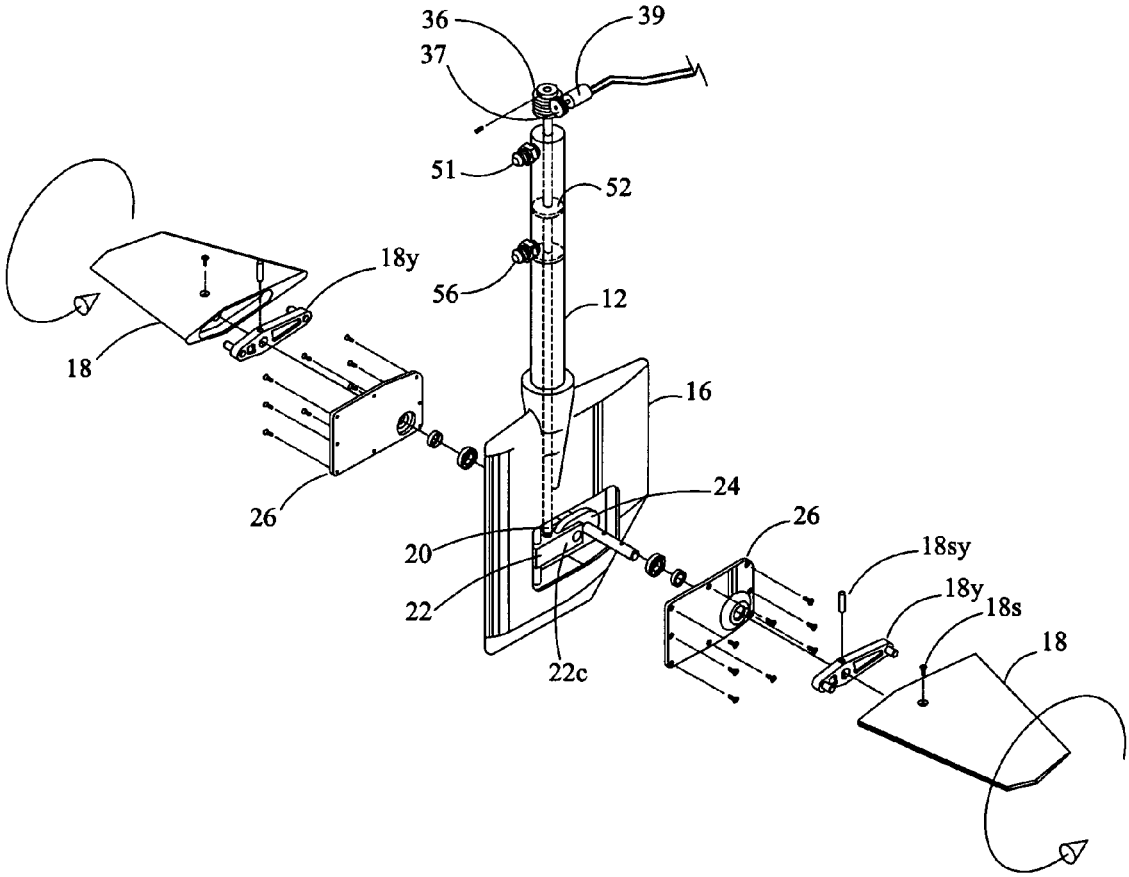
FIG. 11 is an exploded view of an embodiment of a rudder and dynamic trim adjusting apparatus that is hydraulically controlled.

FIG. 11 shows an embodiment of apparatus in which fins 18 are hydraulically controlled. In this arrangement, control rod 20 is directly connected to control nut 22 at its lower end portion and is driven translationally by a hydraulic piston 52 that is driven by application of hydraulic fluid through hydraulic fluid ports 54 and 56 (hydraulic fluid lines not shown). Thus, as piston 52 is driven either up or down, control shaft 20 and control nut 22 translate directly therewith to control rotation of fins 18 in a manner as described previously.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A rudder and dynamic trim adjusting apparatus for a boat, said apparatus comprising:

a rudder;

a rudder shaft having a longitudinal axis, said rudder shaft extending from said rudder and being rotatable about said longitudinal axis to rotate said rudder;

trim fins extending from said rudder, along at least one transverse axis transverse to said longitudinal axis, said trim fins being rotatable independently of said rudder; and a mechanism connected to said trim fins, at least a portion of said mechanism concealed within said trim fins, said mechanism being operable independently of said rotation of said rudder shaft to rotate said trim fins about said at least one transverse axis without moving said rudder shaft, and wherein said rotation of said rudder shaft is independent of said mechanism to rotate said trim fins;

wherein said at least one transverse axis is substantially perpendicular to said longitudinal axis; and wherein said mechanism comprises a pair of transverse shafts, each said transverse shaft having a flat to prevent rotation of said trim fin received thereover, with respect to said transverse shaft, respectively.

2. The apparatus of claim 1, wherein said trim fins are dynamically balanced in rotation about said transverse shafts.

3. The apparatus of claim 1, wherein said flats are angularly offset to compensate for hull torque.

4. The apparatus of claim 1, further comprising a driver operatively connected to said mechanism to drive said mechanism to rotate said fins.

5. The apparatus of claim 4, wherein said driver comprises a motor geared to said mechanism, said motor being operable to drive said mechanism to rotate said fins.

6. The apparatus of claim 4, wherein said driver comprises a hydraulic drive operably connected to said mechanism to drive said mechanisms to rotate said fins.

7. The apparatus of claim 4, wherein said driver is bidirectionally operable, and wherein said fins are rotatable to exert an upward force on a stern of a boat that said apparatus is connected to or to exert a downward force on the stern.

8. The apparatus of claim 7, wherein said driver is dynamically adjustable to dynamically adjust a height of the stern in the water during operation of the boat.

9. The apparatus of claim 4, further comprising an actuator actuatable to operate said driver.

10. The apparatus of claim 9, wherein said actuator is manually operable by an operator.

11. The apparatus of claim 9, wherein said actuator is automatically operable to dynamically adjust said trim fins to maintain a predetermined height of the stern of the boat relative to a bow of the boat.

12. The apparatus of claim 9, wherein said actuator is located in a tow rope handle of a tow rope configured to be attached to a boat.

13. The apparatus of claim 9, further comprising a bow sensor, said bow sensor capable of sensing a change in height of a bow of the boat, relative to a stern of the boat, and communicating with said actuator, wherein said actuator is automatically operable in response to signals received from said bow sensor.

14. A rudder and dynamic trim adjusting apparatus for a boat, said apparatus comprising:

a rudder;

a rudder shaft having a longitudinal axis, said rudder shaft extending from said rudder and being rotatable about said longitudinal axis to rotate said rudder;

trim fins extending from said rudder, along at least one transverse axis transverse to said longitudinal axis, said trim fins being rotatable independently of said rudder; and a mechanism connected within said trim fins, said mechanism being operable independently of said rotation of said rudder shaft to rotate said trim fins about said at least one transverse axis without moving said rudder shaft, and wherein said rotation of said rudder shaft is independent of said mechanism to rotate said trim fins;

wherein said trim fins are dynamically balanced in rotation about said at least one transverse axis; and wherein said mechanism comprises a pair of transverse shafts, each said transverse shaft having a flat to prevent rotation of said trim fin received thereover, with respect to said transverse shaft, respectively.

15. A rudder and dynamic trim adjusting apparatus for a boat, said apparatus comprising:

a rudder;

a rudder shaft having a longitudinal axis, said rudder shaft extending from said rudder and being rotatable about said longitudinal axis to rotate said rudder;

trim fins extending from said rudder, along at least one transverse axis transverse to said longitudinal axis, said trim fins being rotatable independently of said rudder; and a mechanism connected to said trim fins, at least a portion of said mechanism concealed within said trim fins, said mechanism being operable independently of said rotation of said rudder shaft to rotate said trim fins about said at least one transverse axis without moving said rudder shaft, and wherein said rotation of said rudder shaft is independent of said mechanism to rotate said trim fins;

wherein said mechanism comprises a two-piece unit that is separable at a central portion of the unit, wherein upon separation of the two piece unit into two pieces, one of said pieces can be rotated about said transverse axis relative to the other of said two pieces to a rotated configuration and said two pieces can be reconnected in said rotated configuration.

16. The apparatus of claim 15, further comprising a driver operatively connected to said mechanism to drive said mechanism to rotate said fins.

17. The apparatus of claim 16, wherein said driver comprises a motor geared to said mechanism, said motor being operable to drive said mechanism to rotate said fins.

18. The apparatus of claim 16, wherein said driver comprises a hydraulic drive operably connected to said mechanism to drive said mechanisms to rotate said fins.

19. The apparatus of claim 16, wherein said driver is bidirectionally operable, and wherein said fins are rotatable to exert an upward force on a stern of a boat that said apparatus is connected to or a downward force on the stern.

20. The apparatus of claim 16, further comprising an actuator actuatable to operate said driver.

21. The apparatus of claim 20, wherein said actuator is automatically operable to dynamically adjust said trim fins to maintain a predetermined height of the stern of the boat relative to a bow of the boat.

22. The apparatus of claim 20, wherein said actuator is located in a tow rope handle of a tow rope configured to be attached to a boat.

23. The apparatus of claim 20, further comprising a bow sensor, said bow sensor capable of sensing a change in height of a bow of the boat, relative to a stern of the boat, and communicating with said actuator, wherein said actuator is automatically operable in response to signals received from said bow sensor.

* * * * *